US009810134B2

(12) United States Patent
Maki et al.

(10) Patent No.: US 9,810,134 B2
(45) Date of Patent: Nov. 7, 2017

(54) INTERNAL COMBUSTION ENGINE COOLING SYSTEM

(71) Applicant: Ford Global Technologies, LLC, Dearborn, MI (US)

(72) Inventors: Clifford E. Maki, New Hudson, MI (US); Sunil Katragadda, Canton, MI (US); Ravi Gopal, Novi, MI (US); Jody Michael Slike, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 210 days.

(21) Appl. No.: 14/825,577

(22) Filed: Aug. 13, 2015

(65) Prior Publication Data

US 2017/0044967 A1 Feb. 16, 2017

(51) Int. Cl.

| | |
|---|---|
| ***F01P 3/02*** | (2006.01) |
| ***F01P 5/10*** | (2006.01) |
| ***F02F 1/14*** | (2006.01) |
| ***F02F 7/00*** | (2006.01) |
| *F02F 1/10* | (2006.01) |
| *F02F 1/38* | (2006.01) |
| *F01M 11/02* | (2006.01) |

(52) U.S. Cl.

CPC ..... *F01P 3/02* (2013.01); *F02F 1/14* (2013.01); *F02F 7/0007* (2013.01); *F01M 2011/023* (2013.01); *F01P 2003/027* (2013.01); *F02F 1/38* (2013.01); *F02F 2001/104* (2013.01)

(58) Field of Classification Search

CPC .. F01P 3/02; F01P 2003/021; F01P 2003/024; F01P 2003/028; F02F 7/007; F02F 1/10; F02F 1/14; F02F 1/26; F02F 1/36; F02F 1/38; F02F 1/40; F02F 2001/104; F02F 2001/108

USPC ..... 123/41.28, 41.72, 41.74, 41.79, 41.81, 123/41.82 R

See application file for complete search history.

(56) References Cited

U.S. PATENT DOCUMENTS

| | | | | |
|---|---|---|---|---|
| 2,960,974 A | | 11/1960 | Olsen et al. | |
| 3,203,408 A | * | 8/1965 | Winkelman | F01P 3/02 123/41.74 |
| 4,455,972 A | * | 6/1984 | Kawakami | F01P 3/02 123/41.29 |
| 4,494,492 A | * | 1/1985 | Kochanowski | F01P 3/00 123/41.3 |
| 4,660,527 A | * | 4/1987 | Tanaka | F01L 1/0532 123/193.5 |
| 5,076,217 A | | 12/1991 | Clough | |
| 5,379,729 A | * | 1/1995 | Yonezwa | F01P 3/02 123/41.82 R |
| 5,937,802 A | * | 8/1999 | Bethel | F01P 3/02 123/41.08 |
| 5,975,033 A | | 11/1999 | Wada | |
| 6,776,128 B2 | * | 8/2004 | Baba | F01L 3/18 123/41.82 R |

(Continued)

*Primary Examiner* — Grant Moubry

(74) *Attorney, Agent, or Firm* — Brooks Kushman P.C.; Greg Brown

(57) ABSTRACT

An engine has a cylinder block defining a cooling circuit with an inlet passage adjacent to a first end of the block and fluidly connected to a continuous open channel positioned between a side wall of the block and a plurality of in-line cylinders. The channel intersects a block deck face and extends alongside each cylinder of the plurality of cylinders. The channel is configured to direct coolant to a cylinder head.

19 Claims, 5 Drawing Sheets

(56) References Cited

U.S. PATENT DOCUMENTS 6,976,683 B2 * 12/2005 Eckert ..... F01P 3/02 277/591
7,032,547 B2 * 4/2006 Xin ..... F02F 1/14 123/41.72
7,073,476 B2 * 7/2006 Yamamura ..... F02F 7/0085 123/195 R
7,430,994 B2 * 10/2008 Petutsching ..... F01N 3/046 123/41.82 R
7,520,257 B2 * 4/2009 Adams ..... F02F 1/40 123/193.5
7,798,108 B2 * 9/2010 Konishi ..... F02F 1/108 123/41.72
8,312,848 B2 * 11/2012 Weed ..... F02B 75/18 123/41.72
8,474,418 B2 * 7/2013 Shikida ..... F01P 3/02 123/41.74
8,539,916 B2 * 9/2013 Hamakawa ..... F02F 1/14 123/41.72
8,555,825 B2 * 10/2013 Lenz ..... F01P 3/02 123/193.3
8,601,987 B2 * 12/2013 Steiner ..... F01P 3/02 123/196 AB
8,875,669 B2 * 11/2014 Beyer ..... F02F 1/16 123/41.82 R
8,919,302 B2 * 12/2014 Hamakawa ..... F02F 1/14 123/41.67
8,967,094 B2 * 3/2015 Tofukuji ..... F02F 1/14 123/41.74
9,068,496 B2 * 6/2015 Beyer ..... F01P 3/02
9,624,816 B2 * 4/2017 Matsumoto ..... F01P 3/02
2008/0314339 A1 * 12/2008 Koseki ..... F02F 1/4264 123/41.52
2015/0075454 A1 * 3/2015 Hamakawa ..... F02F 1/14 123/41.28

* cited by examiner

INTERNAL COMBUSTION ENGINE COOLING SYSTEM

TECHNICAL FIELD

Various embodiments relate to a cooling system for an internal combustion engine.

BACKGROUND

Internal combustion engines typically have an associated cooling system for thermal management and to control the temperature of the engine and engine components during operation. The cooling system, for example, with a liquid coolant, may be used to cool both the engine block and the cylinder head components.

SUMMARY

In an embodiment, an engine is provided with a cylinder block and a cylinder head. The cylinder block has a block deck face, an intake side wall, an exhaust side wall, and first and second opposed end walls. The block defines a plurality of cylinders arranged in-line with a first end cylinder adjacent to the first end wall and a second end cylinder adjacent to the second end wall. The block defines a block cooling circuit having an inlet passage extending along the first end wall and fluidly connected to a feed channel, with the feed channel intersecting the block deck face and having a continuous perimeter extending lengthwise from a first end adjacent to the first end wall to a second end adjacent to the second end wall. The feed channel is positioned between the exhaust side wall and the plurality of cylinders. The cylinder head has a head deck face and defines a head cooling circuit with at least one inlet port intersecting the head deck face and aligned with the continuous channel to receive coolant therefrom.

In another embodiment, an engine is provided with a cylinder block defining a cooling circuit having an inlet passage adjacent to a first end of the block and fluidly connected to a continuous open channel positioned between a side wall of the block and a plurality of in-line cylinders. The channel intersects a block deck face and extends alongside each cylinder of the plurality of cylinders, and is configured to direct coolant to a cylinder head.

In yet another embodiment, a method of cooling an engine is provided. Coolant is provided from a pump to an inlet passage of a cooling system formed within an engine block. A first portion of the coolant in the inlet passage is split to a fluid jacket surrounding a plurality of cylinders in the block. A second portion of the coolant in the inlet passage is directed to an open feed channel formed within the engine block. The feed channel intersects a block deck face and having a first end fluidly connected to the inlet passage adjacent to a first end of the block and a second end adjacent to a second opposed end of the block. The second portion of the coolant is metered from the feed channel through a series of apertures in a head gasket and to at least one inlet port in a cylinder head deck face. The second portion of the coolant is directed and flows from the at least one inlet port in the cylinder head across the plurality of cylinders in the head to at least one outlet port in the cylinder head deck face. The second portion of the coolant is thereby in a parallel flow circuit with the first portion of the coolant in the fluid jacket of the block. The second portion of the coolant is directed from the at least one outlet port in the head to a return channel formed in the block. The return channel intersects the block deck face and is generally opposed to the feed channel. The first and second portions of coolant are mixed and then provided to the pump.

DETAILED DESCRIPTION

As required, detailed embodiments of the present disclosure are provided herein; however, it is to be understood that the disclosed embodiments are merely examples and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
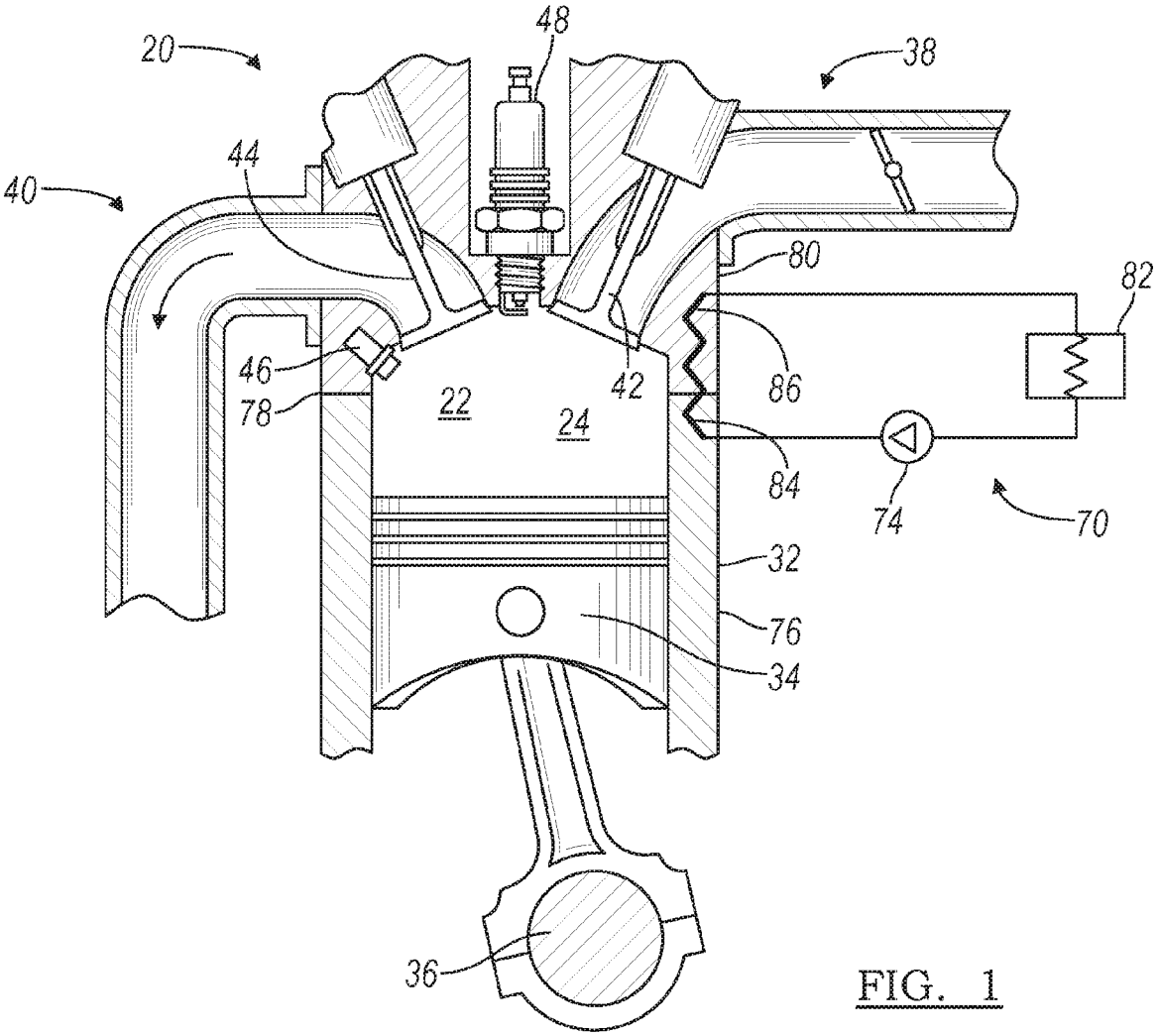
FIG. 1 illustrates a schematic of an internal combustion engine configured to implement the disclosed embodiments.
Figure 2:
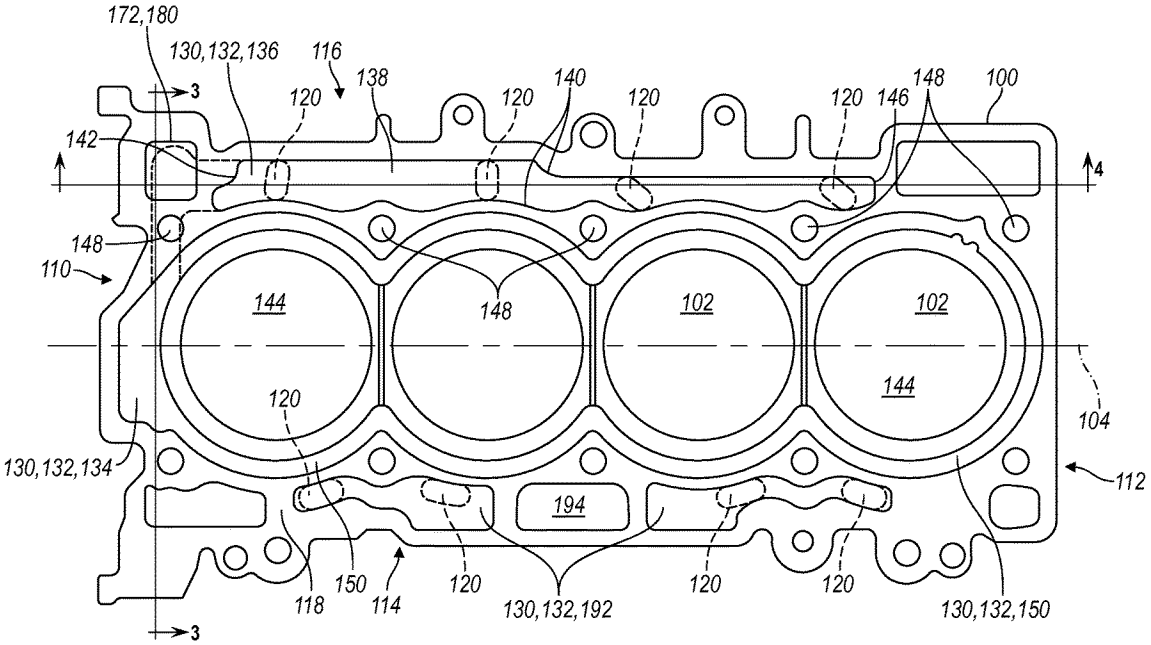
FIG. 2 illustrates a top view of a cylinder block for an engine having a cooling system according to an embodiment.

FIG. 1 illustrates a schematic of an internal combustion engine 20. The engine 20 has a plurality of cylinders 22, and one cylinder is illustrated. In one example, the engine 20 has the cylinders 22 arranged "in-line", and the cylinders 22 may be siamesed in a further example and as shown in FIG. 2 below. The engine 20 has a combustion chamber 24 associated with each cylinder 22. The cylinder 22 is formed by cylinder walls 32 and piston 34. The piston 34 is connected to a crankshaft 36. The combustion chamber 24 is in fluid communication with the intake manifold 38 and the exhaust manifold 40. An intake valve 42 controls flow from the intake manifold 38 into the combustion chamber 24. An exhaust valve 44 controls flow from the combustion chamber 24 to the exhaust manifold 40. The intake and exhaust valves 42, 44 may be operated in various ways as is known in the art to control the engine operation.

A fuel injector 46 delivers fuel from a fuel system directly into the combustion chamber 24 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 24. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, and the like. Engine sensors may include, but are not limited to, an oxygen sensor in the exhaust manifold 40, an engine coolant temperature, an accelerator pedal position sensor, an engine manifold pressure (MAP) sensor, an engine position sensor for crankshaft position, an air mass sensor in the intake manifold 38, a throttle position sensor, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two stroke cycle. During the intake stroke, the intake valve 42 opens and the exhaust valve 44 closes while the piston 34 moves from the top of the cylinder 22 to the bottom of the cylinder 22 to introduce air from the intake manifold to the combustion chamber. The piston 34 position at the top of the cylinder 22 is generally known as top dead center (TDC). The piston 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber 24.

Fuel is then introduced into the combustion chamber 24 and ignited. In the engine 20 shown, the fuel is injected into the chamber 24 and is then ignited using spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve 42 remains closed, and the exhaust valve 44 opens. The piston 34 moves from the bottom of the cylinder to the top of the cylinder 22 to remove the exhaust gases and combustion products from the combustion chamber 24 by reducing the volume of the chamber 24. The exhaust gases flow from the combustion cylinder 22 to the exhaust manifold 40 and to an aftertreatment system such as a catalytic converter.

The intake and exhaust valve 42, 44 positions and timing, as well as the fuel injection timing and ignition timing may be varied for the various engine strokes.

The engine 20 includes a cooling system 70 to remove heat from the engine 20. The amount of heat removed from the engine 20 may be controlled by a cooling system controller or the engine controller. The cooling system 70 may be integrated into the engine 20 as one or more cooling circuits. The cooling system 70 may contain water or another liquid coolant as the working fluid. In one example, the cooling system 70 has a first cooling circuit 84 in the cylinder block 76 and a second cooling circuit 86 in the cylinder head 80 with the circuits 84, 86 in fluid communication with one another as described below with reference to FIG. 2. Coolant, such as water, in the cooling system 70 flows from an area of high pressure towards an area of lower pressure.

The cooling system 70 has one or more pumps 74 that provide fluid to cooling passages in the circuits 84, 86. The cooling system 70 may also include one or more valves, thermostats, and the like to control to flow or pressure of coolant, or direct coolant within the system 70. At least some of the cooling passages in the cylinder block 76 may form a cooling jacket surrounding and adjacent to one or more of the cylinders 22 and the bore bridges formed between the cylinders 22. Similarly, at least some of the cooling passages in the cylinder head 80 may be adjacent to one or more of the combustion chambers 24 and cylinders 22, and the bore bridges formed between the combustion chambers 24, exhaust valves, exhaust valve seats, and other components.

The cylinder head 80 is connected to the cylinder block 76 to form the cylinders 22 and combustion chambers 24. A head gasket 78 in interposed between the cylinder block 76 and the cylinder head 80 to seal the cylinders 22. The gasket 78 may also have various slots, apertures, or the like to fluidly connect the jackets 84, 86. The cooling system 70 may also include various heat exchangers, such as a radiator 82, where heat is transferred from the coolant to the environment or the coolant is used to cool or heat other engine or vehicle components and/or working fluids.

FIGS. 2-5 illustrate an example of the present disclosure that may be implemented with the engine 20 illustrated in FIG. 1. The example shown provides for a flow circuit to manage the thermal gradients of the engine block and the cylinder head components, and the operating temperature of the engine and its components. A feed channel or trough style trench is provided in the cylinder block deck face and is placed outside the head bolt columns of the engine block. The feed channel is configured to distribute and deliver coolant to all cylinders in the head substantially uniformly and essentially acts as an internal manifold plenum. The cooling strategy of flowing from the block to the head via the channel is effective in that it provides for a cast-in feature of the block that distributes the coolant to cross flow inlets on the cylinder head on the exhaust side of the engine. The branch flow up into the cylinder head allows for a controlled coolant flow to high heat regions of the cylinder head, e.g. the exhaust ports and exhaust valve seats. The channel or trough enables the engine to have a split flow, parallel cooling strategy where a portion of the coolant in the block is used to cool the block and another portion is directed to the head, as well as a cross-flow strategy in the head.

FIG. 2 illustrates a top view of an engine block 100 for an internal combustion engine. In one example, the engine block 100 may be used with the engine 20 of FIG. 1. The engine block 100 is shown as having four cylinders 102 arranged in an in-line, siamesed configuration along a longitudinal axis 104 of the block 100, although other numbers of cylinders 102 and arrangements for the cylinders is contemplated for other embodiments.

The block 100 has a first end wall 110, a second opposed end wall 112, a first side wall 114, a second side wall 116, and a deck face 118. The first side wall 114 may be on an intake side of the engine, or the side of the engine associated with the air intake and intake valves. The second side wall 116 may be on an exhaust side of the engine, or the side of the engine associated with the cylinder exhaust gases and the exhaust valves. The deck face 118 of the block 100 is configured to mate with a corresponding deck face of the cylinder head, and a head gasket may be positioned therebetween to seal the cylinders 102. The head gasket is not illustrated in FIG. 2; however, FIG. 2 illustrates the apertures 120 and slots in the head gasket discussed below in broken lines.

The engine has a cooling system 130 which includes a cooling circuit 132 in the block 100 of cooling passages that are integrally formed within the block, for example, during a casting process, molding process, or by machining the block 100 after formation. The cooling system 130 may correspond to cooling system 70 in FIG. 1.

The cooling circuit 132 has an inlet passage 134 adjacent to the first end 110 of the block. The inlet passage 134 is fluidly connected within the block 100 to a continuous open channel 136 or trough. The open channel or feed channel 136 is positioned between the side wall 116 and the cylinders 102. The channel 136 is an open channel as it is defined by the block with a floor 138 and a side wall 140, and is open along the deck face 118. The channel may be provided as a "cast in" feature of the block 100. The channel 136 intersects the deck face 118 and extends alongside each cylinder 102 of the block 100. The channel 136 has a first end 142 that is adjacent to one of the end cylinders 144 and a second end 146 that is adjacent to the other end cylinder 144. The channel 136 has an elongated shape and may be parallel or substantially parallel with the longitudinal axis 104. The channel 136 is sized and shaped to direct or feed coolant to the cylinder head. The channel 136 therefore acts as a manifold component or plenum for the coolant that is to be directed to the cylinder head, and is integrated into the cylinder block. By integrating the channel 136 into the block 100, issues with leakage and manufacturability may be reduced as well as costs, and control over coolant flow to the head may be improved.

The channel 136 is illustrated as being positioned outside head bolt columns 148 defined in the block and the cylinders 102. The head bolt columns 148 cooperate with head bolts to attach the cylinder head to the block 100 and enclose the combustion chamber 24. The channel 136 is positioned as shown to provide sealing of the cylinders and allow for packaging of the channel 136 using the head gasket between the deck faces of the block and the head.

The inlet passage 134 is fluidly connected to a fluid jacket 150. The fluid jacket 150 is formed in the block 100 to surround the plurality of cylinders 102 and direct coolant and remove heat from the engine during operation. The fluid jacket 150 circumferentially surrounds the cylinders 102, and may generally follow the outer perimeter of the cylinder 102 liners as shown. The fluid jacket 150 extends from the deck face 118 into the block 100. The fluid jacket 150 may include various cooling features such as bore bridge cooling passages and the like to enhance heat transfer and manage the cylinder liner temperature.

Figure 3:
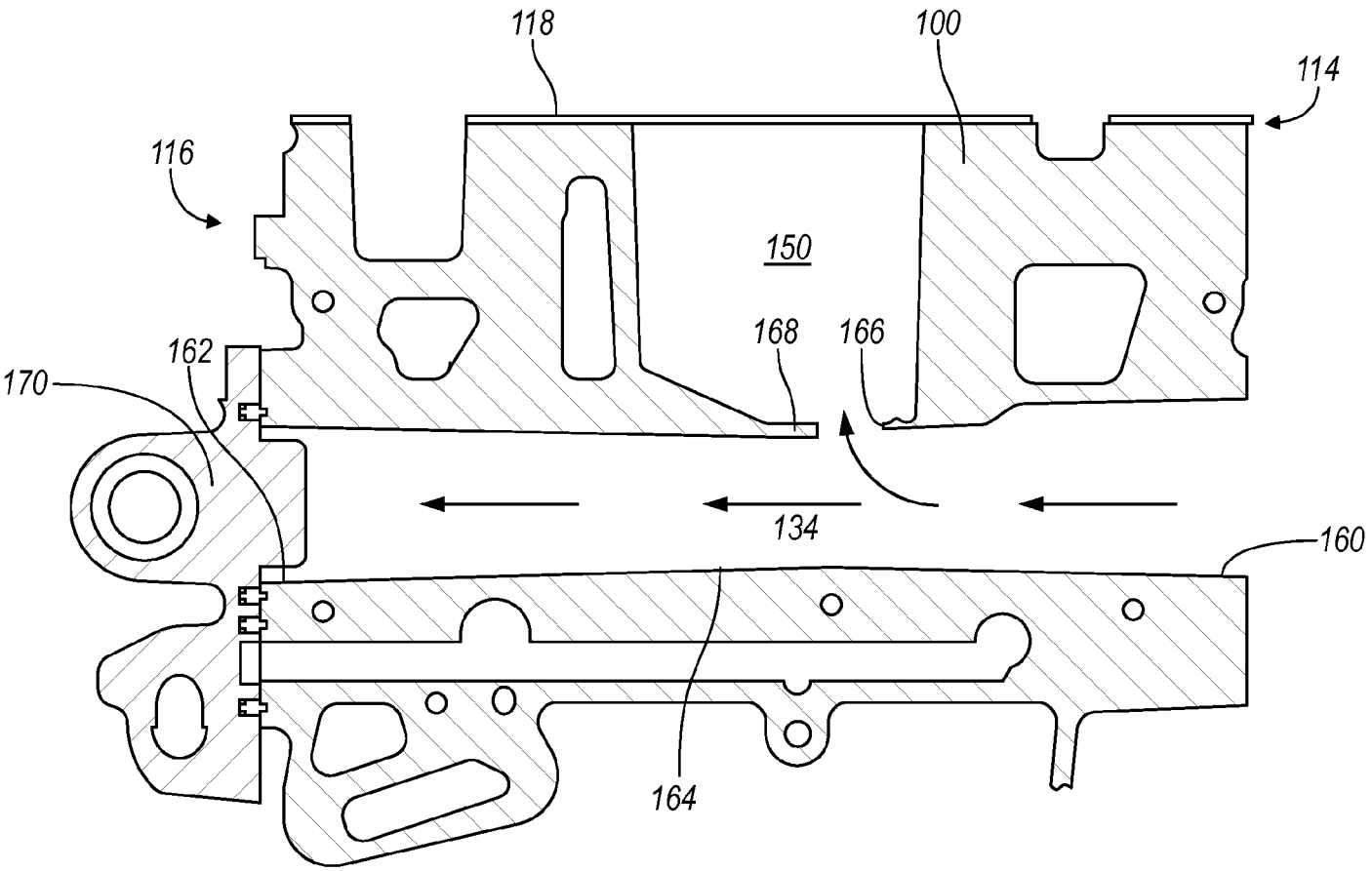
FIG. 3 illustrates a sectional side view of the engine of FIG. 2.

Referring to FIG. 3, the inlet passage 134 is illustrated in a sectional view of the block 100. The inlet passage 134 extends alongside and is adjacent to the end wall 110 of the block 100. The inlet passage may be perpendicular to or at a non-parallel angle relative to the longitudinal axis 104.

In one example, the inlet passage 134 is defined as a through passage in the block 100 such that it extends through both the intake and exhaust sides 114, 116 of the block 100. The inlet passage 134 has an inlet port 160 that is configured to receive flow from a pump in the cooling system. In one example, the pump may be directly connected to the block 100 on a mounting face adjacent to the inlet port 160, and in other examples, the pump may be remote from the block 100 and connected via a tubing connection.

The inlet passage 134 may have a second port 162 or opening on the exhaust side 116. The inlet passage connects to the feed channel 136 adjacent to this port 162. The inlet passage 134 has an intermediate region 164 positioned between the ports 160, 162. The intermediate region 164 includes an opening 166 to direct a portion of the coolant in the passage 134 into the fluid jacket 150. The opening may include a ramp 168 or other feature to introduce a directional component into the flow to cause at least some of the coolant to flow upwards in FIG. 3 and into the jacket 150. The fluid jacket 150 may be fluidly connected to the inlet passage 134 upstream of the feed channel 136.

Note that in one example, all of the coolant from the pump may enter the inlet passage 134 with a portion of the coolant being directed to the jacket 150, and another portion of the remainder of the coolant being directed to the channel 136. Note that in the example shown, the feed channel 136 acts as a manifold component or plenum for coolant to the cylinder head such that all coolant for the head cooling circuit is provided through the inlet passage 134 of the block cooling circuit and the feed channel 136.

The block 100 may include a cap 170 or cover plate 170 to enclose and cover the open end 162 of the inlet passage 134. The cap 170 may be configured to connect to the exhaust side 116 of the block and enclose the connection between the inlet passage 134 and the feed channel 136. The cap 170 may include a concave surface 172, as shown in broken lines in FIG. 2, to assist in directing flow, turning the flow of coolant from the inlet passage 134 to the feed channel 136, and reducing the pressure drop caused by the turn. In other embodiments, the passage 134 may not extend as a through passage in the block.

Figure 4:
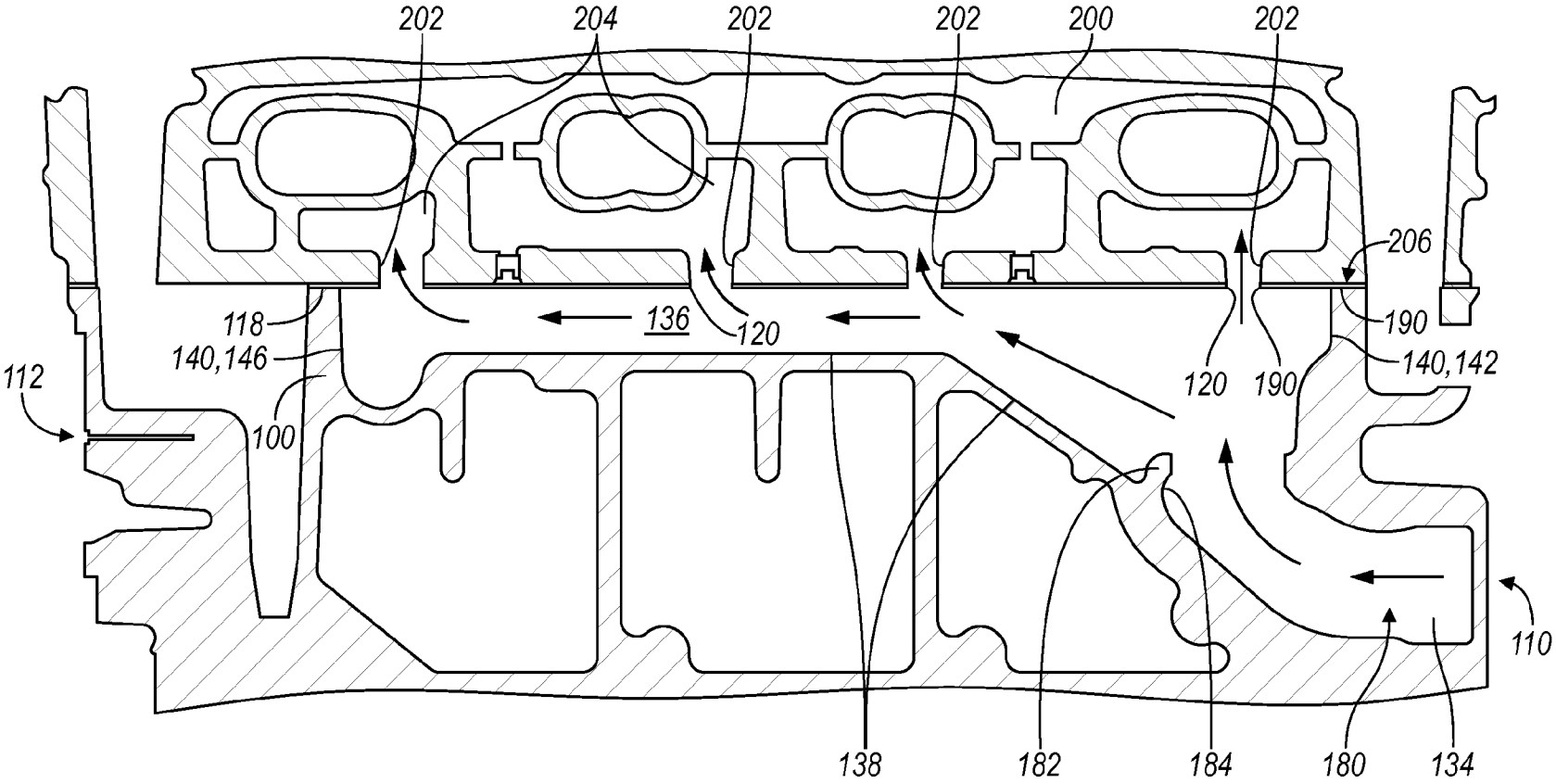
FIG. 4 illustrates another sectional side view of the engine of FIG. 2.

FIG. 4 illustrates a sectional view of the block 100 and a cylinder head 200 for the engine. The cylinder head 200 may be used as head 80 of the engine 20 illustrated in FIG. 1. The coolant flows from the inlet passage 134 and into the channel 136 in a connection region 180. The connection region 180 may include a ninety degree turn in one example such that the coolant changes from a transverse flow direction to a longitudinal flow direction in the block 100. The inlet passage 134 is fluidly connected to the channel 136 adjacent to the first cylinder 144, and the end 110 of the block 100.

The channel 136 includes a floor 138 that is spaced apart from the deck face 118. The floor 138 may be sloped or otherwise shaped such that a distance between the floor 138 and the deck face 118 of the block decreases along the length of the channel and decreases downstream and away from the inlet channel 134. The floor 138 may have sections that are continually sloped, as shown, or may be continually sloped for the length of the channel 136. The depth of the channel 136 at the first end 110 is greater than the depth downstream in the channel 136 at the second end 112 of the block. The decreasing depth of the channel 136 along the length of the channel in a downstream direction acts to control the coolant pressure along the length of the channel such that coolant is provided to each cylinder in the cylinder head at substantially the same pressure and/or flow rate.

The floor 138 of the channel 136 may have a protrusion 182 that extends outwardly or upwardly from the floor 138 and towards the deck face 118. The channel 136 is illustrated as having a single protrusion 182, although any number of protrusions and various locations for the protrusions are contemplated. The protrusion 182 may be adjacent to the inlet passage 134 and the end 110 of the block. Due to the depth of the channel 136 at this end 110, and associated greater distance from the deck face 118, the protrusion is used to impart a vertical component to the coolant flow and direct coolant upwards towards the region of the cylinder head 200 associated with the end cylinder 144 at this end 110. The protrusion 182 therefore acts to redirect a portion of the coolant flow to provide a more even coolant distribution in the channel 136 and along the deck face 118 to the head 200. The protrusion 182 may have various surface features, such as a concave upstream side 184, to better direct or control the coolant flow.

A head gasket 190 is positioned between the block 100 and the head 200. The head gasket 190 defines a series of apertures 120, as shown in FIG. 2, that are positioned between and fluidly connect the feed channel 136 of the block 100 one or more inlet ports 202 of the head 200. The apertures 120 are aligned with the inlet ports 202 and the channel 136. The head gasket 190 may be formed as a multi-layer steel head gasket with a vulcanized rubber bead to keep the coolant system sealed and separated from oil drain passages, etc.

The head 200 may have one or more inlet ports 202 that are configured to receive coolant flow from the channel 136 and into the cooling circuit 204 of the head 200. The inlet ports 202 intersect the head deck face 206. The cooling circuit 204 may be the circuit 86 of FIG. 1. The head 200 may have a single cooling circuit, or may have multiple cooling circuits, such as an upper and a lower cooling circuit. In the example shown, the head cooling circuit 204 has one port 202 associated with each cylinder 102 in the head 200 and the engine. In other examples, more than one port 202 per cylinder 102 may be provided.

The apertures 120 in the head gasket 190 may be of the same size or substantially similar size and shape. In other examples, the apertures 120 may vary in shape and positioning as shown to control the direction and/or rate coolant flow through the apertures 120. The apertures 120 may also have different sizes or cross sectional areas to meter the flow of coolant through each aperture 120 and to the associated cylinder in the head 200.

In the example shown, the apertures 120 in gasket 190 are spaced apart along the length of the channel 136. Each cylinder 102 in the engine may have one or more apertures 120 associated with it. In the example shown, there is one aperture 120 for each cylinder 102 to direct and meter the flow of coolant into the head 200 for that cylinder. The cross sectional area of each aperture 120 may increase downstream in the feed channel 136, or increase from right to left in FIG. 4, to provide a substantially equal amount of coolant to each cylinder. In other examples, the middle apertures 120 may be sized to a larger cross sectional area than the outer apertures associated with end cylinders, as the middle cylinders may require additional cooling to operate at a similar temperature compared with the end cylinders.

Figure 5:
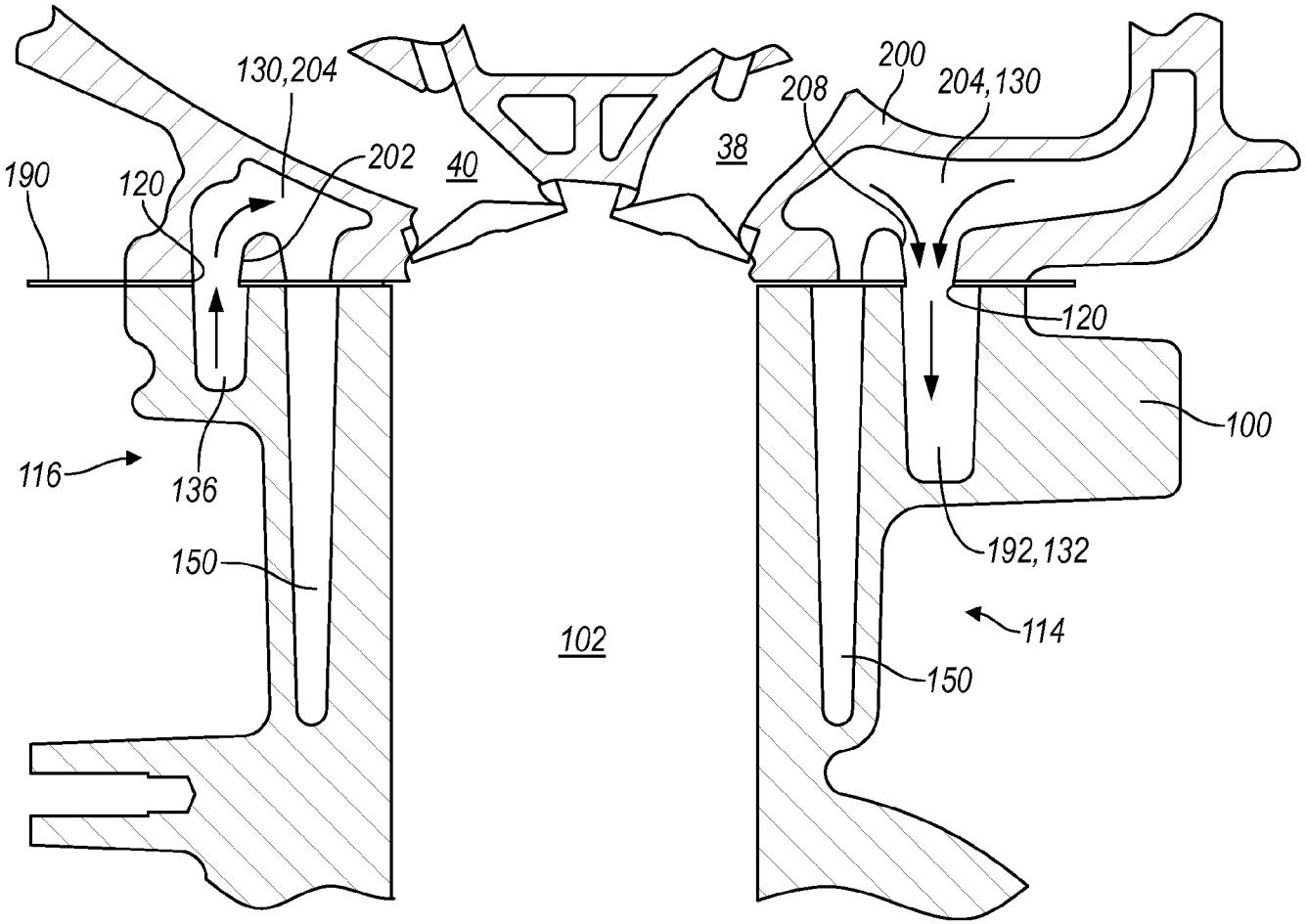
FIG. 5 illustrates yet another sectional side view of the engine of FIG. 2.

FIG. 5 illustrates another sectional view of the engine. The coolant enters the head 200 through the inlet ports 202 and flows into the head cooling circuit 204. The inlet ports 202 are along a side of the engine, such as the exhaust side 116. The coolant in the head cooling circuit 204 flows generally transversely across the head 200, e.g. from the exhaust side 116 to the intake side 114, or substantially perpendicular to or at an angle relative to longitudinal axis 104. At least a portion of the coolant in the head 200 then flows from the head cooling circuit 204, down through at least one outlet port 208 defined in the cylinder head deck face 206, through aperture 120 on the intake side 114, and to a return channel 192 in the block 100. The head 200 may have one or more outlet ports 208 per cylinder 102.

The return channel 192 forms a part of the cooling system 130 and of the cooling circuit 132 in the block 100. The return channel 192 intersects the block deck face 118 and is positioned between the intake side wall 114 of the block and the plurality of cylinders 102. The return channel 192 may be generally opposed to the continuous feed channel 136. The cooling system may have one or more return channels 192. In the example shown, there are two return channels 192, based on the central placement of an oil drain channel 194.

The coolant in the fluid jacket 150 and the coolant in the return channel 192 are then combined and flow to the pump for recirculation through the cooling system 130.

The engine is therefore cooled by providing coolant from a pump 74 to an inlet passage 134 of a cooling system 130 formed within an engine block 100. A first portion of the coolant in the inlet passage 134 is split off to a fluid jacket 150 surrounding a plurality of cylinders 102 in the block 100. A second portion of the coolant, or the remainder of the coolant, in the inlet passage 134 is provided to an open feed channel 136 formed within the engine block 100. The feed channel 136 intersects a block deck face 118 and has a first end 142 fluidly connected to the inlet passage 134 adjacent to a first end 110 of the block 100 and a second end 146 adjacent to a second opposed end 112 of the block 100. The second portion of the coolant is metered from the feed channel 136 through a series of apertures 120 in a head gasket 190 and to at least one inlet port 202 in a cylinder head 200 deck face 206.

The second portion of the coolant flows across the plurality of cylinders 102 in the head 200 from the inlet ports 202 to the outlet ports 208. The second portion of the coolant therefore forms a parallel flow circuit with the first portion of the coolant in the fluid jacket 150 of the block.

The second portion of the coolant in the head is directed and flows from the outlet ports 208 in the head 200 to one or more return channels 192 formed in the block 100. The return channels 192 intersecting the block deck face 118 and are generally opposed to the feed channel 136. The first and second portions of the coolant are then recombined or mixed, completing the parallel flow circuit, and then provided to the pump for recirculation.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. An engine comprising:

a cylinder block having a block deck face, an intake side wall, an exhaust side wall, and first and second opposed end walls, the block defining a plurality of cylinders arranged in-line with a first end cylinder adjacent to the first end wall and a second end cylinder adjacent to the second end wall, the block defining a block cooling circuit having an inlet passage extending along the first end wall and fluidly connected to a feed channel, the feed channel intersecting the block deck face and having a continuous perimeter extending lengthwise from a first end adjacent to the first end wall to a second end adjacent to the second end wall, the channel positioned between the exhaust side wall and the plurality of cylinders, wherein the inlet passage of the block extends through the block from the intake side to the exhaust side, the inlet passage having an inlet port on the intake side of the engine, the block having a cap configured to connect to the exhaust side of the engine and enclose an intersection fluidly connecting the inlet passage and the feed channel; and a cylinder head having a head deck face and defining a head cooling circuit with at least one inlet port intersecting the head deck face and aligned with the feed channel to receive coolant therefrom.

2. The engine of claim 1 further comprising a head gasket interposed between the block deck face and the head deck face, the head gasket defining a series of apertures positioned between and fluidly connecting the feed channel and the at least one inlet port.

3. The engine of claim 2 wherein the series of apertures of the head gasket are spaced apart along the length of the feed channel, wherein each aperture is associated with a respective cylinder in the plurality of cylinders and a cross sectional area of each aperture increases downstream in the feed channel.

4. The engine of claim 1 wherein the block cooling circuit includes a fluid jacket surrounding the plurality of cylinders and fluidly connected to the inlet passage upstream of the feed channel.

5. The engine of claim 4 wherein the inlet passage of the block cooling circuit is configured to direct a portion of the coolant within the inlet passage to the fluid jacket, and a remainder of the coolant in the inlet passage to the feed channel; and wherein all coolant in the head cooling circuit is provided from the inlet passage of the block cooling circuit.

6. The engine of claim 1 wherein the block cooling circuit defines a return channel intersecting the block deck face and positioned between the intake side wall and the plurality of cylinders, the return channel generally opposed to the feed channel; and wherein the head cooling circuit defines at least one outlet port intersecting the head deck face and aligned with the return channel to provide coolant thereto.

7. The engine of claim 1 wherein a distance between a floor of the channel and the block deck face decreases along a length of the channel in a downstream direction thereby providing coolant to each cylinder in the cylinder head at substantially the same pressure.

8. The engine of claim 1 wherein the cap has a concave surface configured to form a wall of the cooling circuit between the inlet passage and the feed channel and direct flow from the inlet passage to the feed channel.

9. An engine comprising:

a cylinder block defining a cooling circuit having an inlet passage adjacent to a first block end and fluidly connected to (i) a fluid jacket circumferentially surrounding a plurality of cylinders and (ii) a continuous open channel positioned between a side block wall and the jacket and configured to direct coolant to a cylinder head, the channel intersecting a block deck face and extending alongside each cylinder of the plurality of cylinders.

10. The engine of claim 9 wherein the channel has a floor spaced apart from the deck face and a continuous side wall extending from the floor to the deck face.

11. The engine of claim 10 where a distance between the floor of the channel and the deck face is decreasing along a length of the channel and away from the inlet passage.

12. The engine of claim 10 wherein the plurality of cylinders extends along a longitudinal axis of the block with a first cylinder adjacent to the first end of the block and a second cylinder adjacent to a second end of the block; and wherein the continuous open channel is substantially parallel with the longitudinal axis and extends from the first cylinder to the second cylinder.

13. The engine of claim 12 wherein the inlet passage is fluidly connected to the channel adjacent to the first cylinder.

14. The engine of claim 13 wherein the floor of the channel has a protrusion extending towards the deck face and adjacent to the inlet passage, the protrusion configured to redirect coolant towards the first cylinder.

15. The engine of claim 14 wherein the protrusion has an upstream side, the upstream side being concave.

16. The engine of claim 9 wherein the fluid jacket is fluidly connected to the inlet passage upstream of the channel.

17. The engine of claim 9 wherein the cooling circuit of the block defines a return channel intersecting the block deck face and positioned between another block side wall and the fluid jacket, the return channel generally opposed to the continuous channel, the return channel configured to receive coolant from the cylinder head.

18. The engine of claim 9 wherein the block defines a series of head bolt columns along the side wall, the channel positioned between the series of head bolt columns and the side wall.

19. A method of cooling an engine comprising:

providing coolant from a pump to an inlet passage of a cooling system formed within an engine block, the cooling system having an inlet passage fluidly connected to (i) a fluid jacket circumferentially surrounding a plurality of cylinders and (ii) an open feed channel intersecting a block deck face and having a first end fluidly connected to the inlet passage adjacent to a first end of the block and a second end adjacent to a second opposed end of the block, the feed channel positioned between the fluid jacket and a first side of the block;

splitting a first portion of the coolant in the inlet passage to the fluid jacket;

directing a second portion of the coolant in the inlet passage to the open feed channel;

metering the second portion of the coolant from the feed channel through a series of apertures in a head gasket and to at least one inlet port in a cylinder head deck face;

flowing the second portion of the coolant from the at least one inlet port in the cylinder head across the plurality of cylinders in the head to at least one outlet port in the cylinder head deck face, the second portion of the coolant in a parallel flow circuit with the first portion of the coolant in the fluid jacket of the block;

directing the second portion of the coolant from the at least one outlet port in the head to a return channel formed in the block, the return channel intersecting the block deck face and generally opposed to the feed channel, the return channel positioned between the fluid jacket and a second side of the block; and mixing and providing the first and second portions of coolant to the pump.

* * * * *